United States Patent [19]

Unger et al.

[11] Patent Number: 4,852,356

[45] Date of Patent: Aug. 1, 1989

[54] CRYOGENIC COOLER

[75] Inventors: Rueven Z. Unger, Kfar-Vradim; Mark Kushnir, Rehovot, both of Israel

[73] Assignee: ICE Cryogenic Engineering Ltd., Tel Aviv, Israel

[21] Appl. No.: 26,037

[22] Filed: Mar. 16, 1987

[30] Foreign Application Priority Data

May 27, 1986 [IL] Israel ..... 78933

[51] Int. Cl.[4] ..... F25B 9/00

[52] U.S. Cl. ..... 62/6; 60/520

[58] Field of Search ..... 62/6, 295; 60/526, 520

[56] References Cited

U.S. PATENT DOCUMENTS 3,853,437 12/1974 Horn et al. .
3,877,239 4/1975 Leo .
3,889,119 6/1975 Whicker et al. .
3,906,739 9/1975 Raimondi .
3,913,339 10/1975 Berry .
4,092,829 6/1978 Durenec .
4,277,948 7/1981 Horn et al. .
4,394,819 7/1983 Averill ..... 62/295
4,403,478 9/1983 Robbins .
4,412,423 11/1983 Durenec .
4,430,863 2/1984 Longsworth .
4,481,777 10/1984 Sarcia .
4,501,120 2/1985 Holland .
4,514,987 5/1985 Pundak et al. .
4,520,629 6/1985 Dix et al. .
4,539,818 9/1985 Holland .
4,550,571 11/1985 Bertsch .
4,569,203 2/1986 Rawlings et al. .
4,619,112 10/1986 Colgate ..... 62/6

*Primary Examiner*—Henry A. Bennet
*Attorney, Agent, or Firm*—Amster, Rothstein & Ebenstein

[57] ABSTRACT

An integral Stirling cryogenic cooler including a compressor, an expander-displacer portion defining an expansion volume, a cold tip adjacent the expansion volume, a cold tip adjacent the expansion volume, a regenerator heat exchanger and a displacer, a crank shaft arranged to receive input rotary power and to drive the compressor and the displacer, and apparatus for low vibration mounting of the expander-displacer portion with respect to the compressor.

15 Claims, 4 Drawing Sheets

CRYOGENIC COOLER

FIELD OF THE INVENTION

The present invention relates to cryogenic refrigerators generally and more particularly to Stirling cryocoolers of the integral type.

BACKGROUND OF THE INVENTION

In recent years thermal imaging technology has developed a capability of providing images of television quality or better for various applications, such as aerial terrain mapping, target determination and acquisition, surveillance, electrical fault location, medical imaging, and irrigation control.

One particularly useful technique for thermal imaging is known as "cool IR". This technique has the advantage of being able to carry out imaging over great distances, in total darkness, on camouflaged objects and through cloud cover. Cool IR systems require an IR detector to be cooled to the temperature of liquid air, about 77 K, for efficient operation.

Various types of cryogenic refrigerators are known for cool IR applications. These include liquid nitrogen cryostats, Joule-Thomson coolers and closed cycle cryocoolers. For certain applications, closed cycle cryocoolers are preferred.

There exist a variety of configurations of closed cycle cryocoolers. These include Stirling, Vuilleumier (VM) and Gifford-McMahon (GM) cryocoolers. A preferred configuration is the integral type.

A basic integral Stirling cryocooler comprises a compressor section and an expander-displacer section combined in one integrated package. Reciprocating elements of both the expander-displacer and the compressor are mechanically driven via a common crankshaft. The integral configuration guarantees a prescribed displacer stroke and displacer/compressor phase relationship, but it involves a disadvantage in that the vibration output of the compressor is transmitted to the cooled device due to the close proximity of the components.

A further disadvantage in integral Stirling crycoolers lies in their compressor seals. Various types of dynamic compressor seals are employed, including clearance seals. These tend to wear over time, releasing particulate matter into the system; this interferes with the operation of the Stirling regenerator.

Additional contamination of the regenerator is caused by lubrication materials and other materials associated with parts of the drive motor which are generally located in fluid communication with the regenerator.

SUMMARY OF THE INVENTION

The present invention seeks to provide an improved integral Stirling cryogenic cooler which overcomes some or all of the above-described disadvantages.

There is thus provided in accordance with a preferred embodiment of the present invention an integral Stirling cryogenic cooler including a compressor, an expander-displacer portion defining an expansion volume, a cold tip adjacent the expansion volume, a regenerator heat exchanger and a displacer, a crank shaft arranged to receive input rotary power and to drive the compressor and the displacer, and apparatus for low vibration mounting of the expander-displacer portion with respect to the compressor.

In accordance with this embodiment of the invention, vibration sensitive apparatus to be cooled, such as an IR detector, may be mounted directly on the cold tip.

According to a preferred embodiment of the invention, the apparatus for low vibration mounting comprises a sealed bellows mounting.

There is also provided in accordance with a preferred embodiment of the present invention, an integral Stirling cryogenic cooler including a compressor, an expander-displacer portion defining an expansion volume, a cold tip adjacent the expansion volume, a regenerator heat exchanger and a displacer, a crank shaft arranged to receive input rotary power and to drive the compressor and the displacer and electric motor apparatus including a stator located externally of the compressor and expander-displacer portion and not in fluid communication with the interiors thereof.

Additionally in accordance with an embodiment of the present invention, there is provided an integral Stirling cryogenic cooler including a compressor, an expander-displacer portion defining an expansion volume, a cold tip adjacent the expansion volume, a regenerator heat exchanger and a displacer, a crank shaft arranged to receive input rotary power and to drive the compressor and the displacer, and wherein the compressor includes a dynamic labyrinth seal.

According to a preferred embodiment of the present invention, all of the above features are incorporated into the cryogenic cooler. According to alternative embodiments of the invention, various combinations of the above features may be incorporated in a cryogenic cooler.

BRIEF DESCRIPTION OF THE DRAWINGS

The present invention will be understood and appreciated more fully from the following detailed description taken in conjunction with the drawings in which.

DETAILED DESCRIPTION OF A PREFERRED EMBODIMENT

Figure 1A:
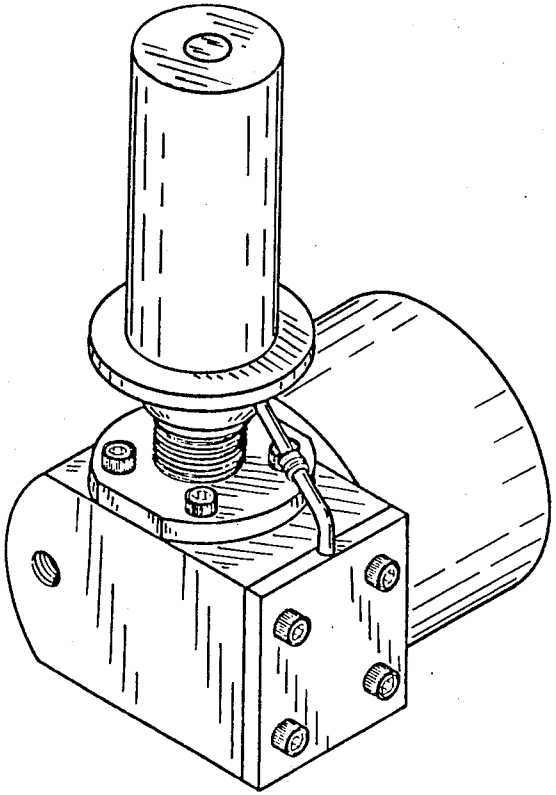
FIGS. 1A and 1B respectively are pictorial and side view illustrations of a cryogenic cooler constructed and operative in accordance with a preferred embodiment of the present invention.
Figure 1B:
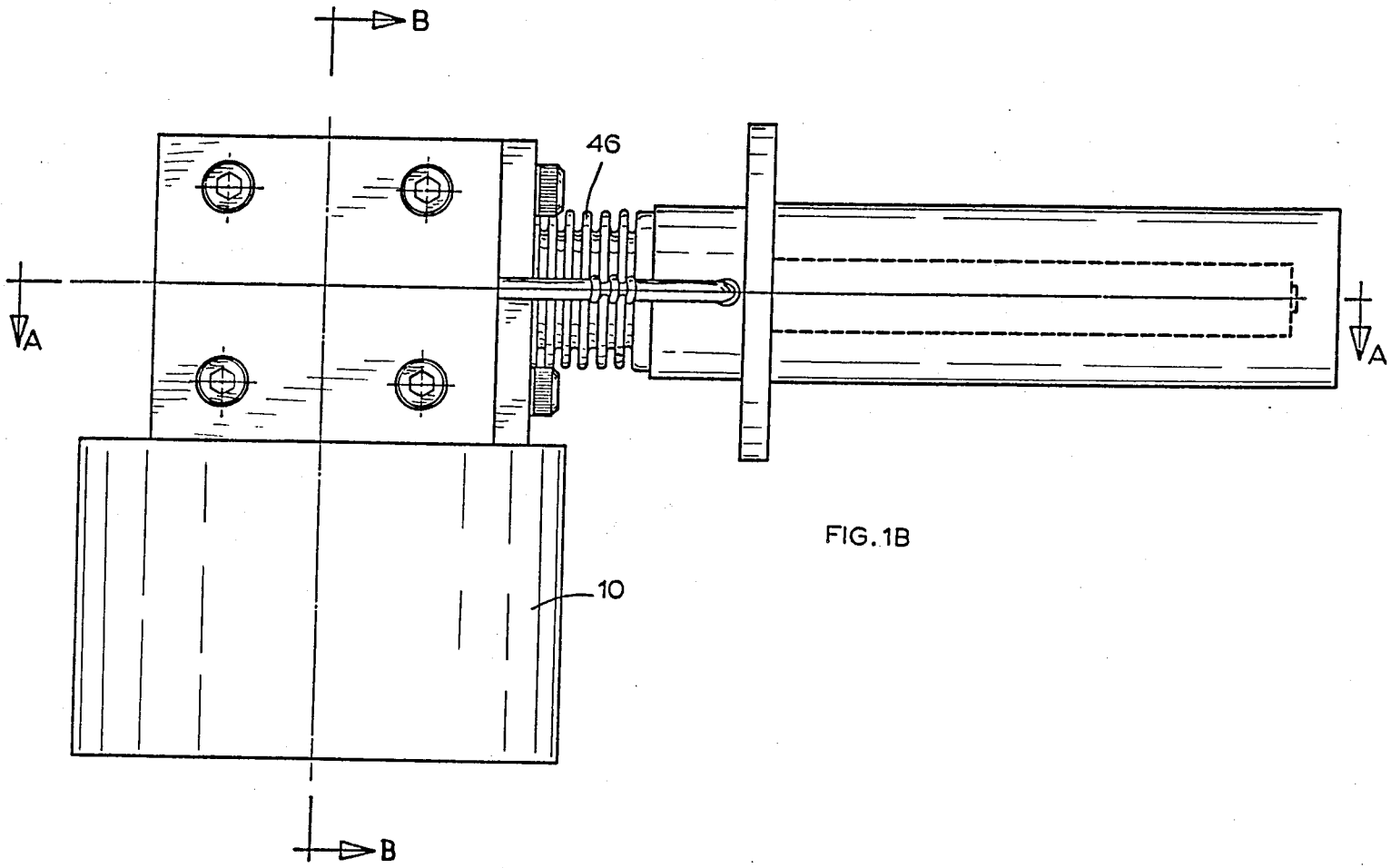
Figure 2:
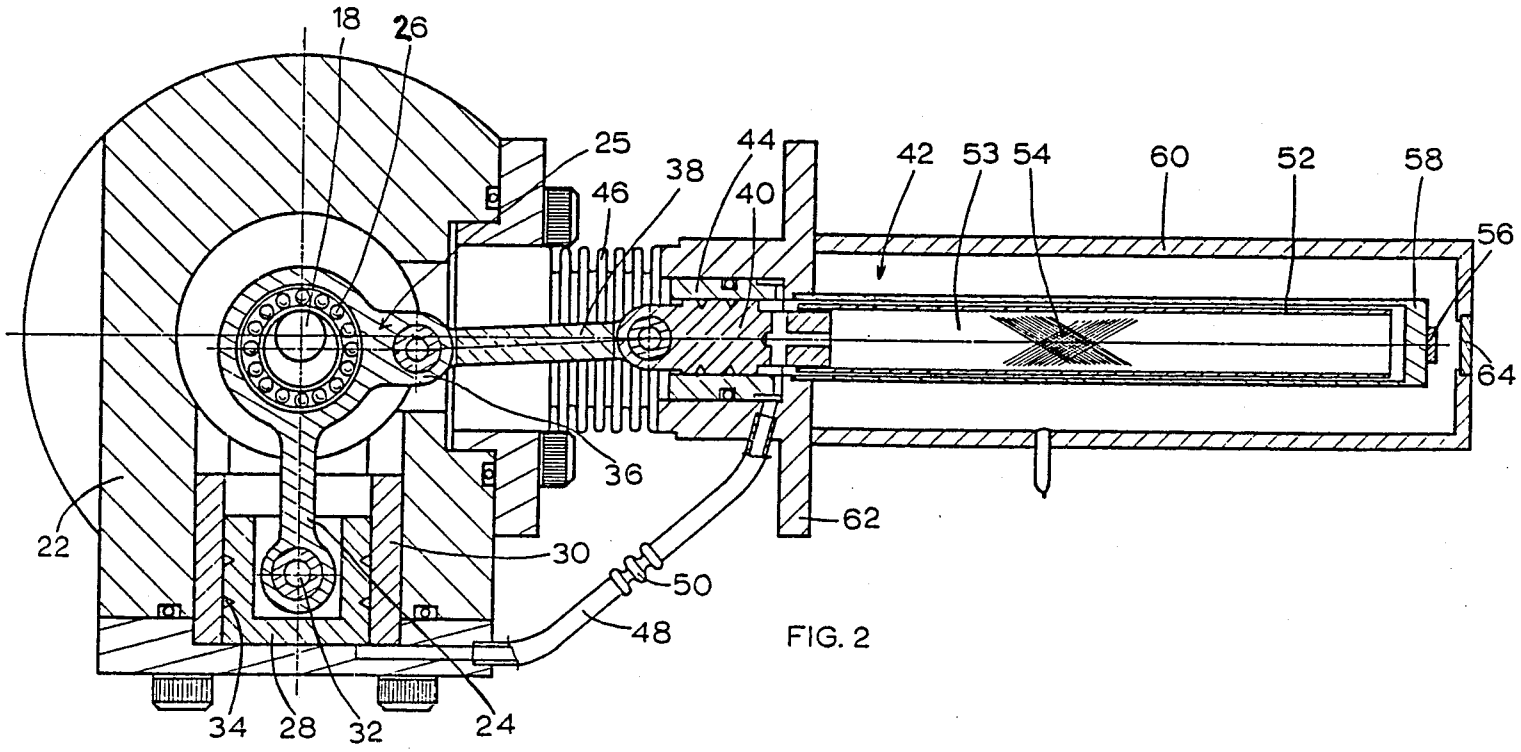
FIG. 2 is a sectional illustration of the cryogenic cooler of FIGS. 1A and 1B taken along the lines A—A drawn on FIG. 1B.
Figure 3:
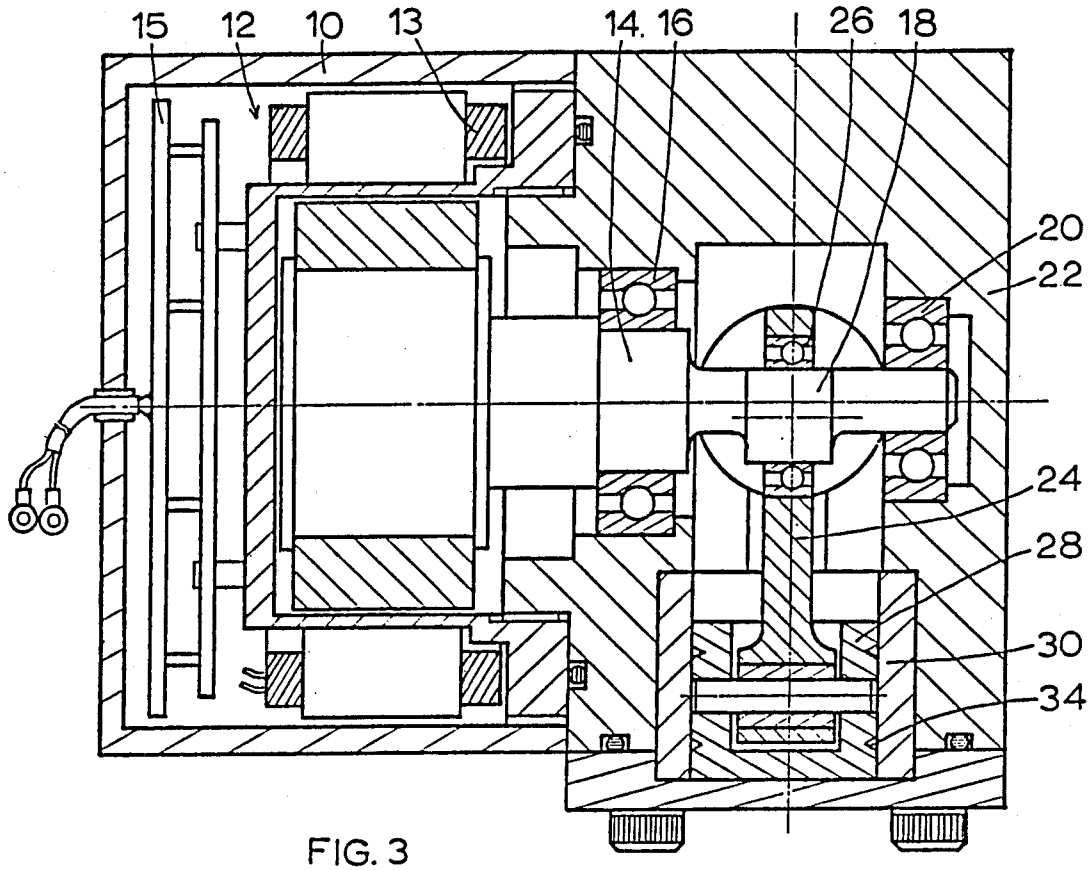
FIG. 3 is a sectional illustration of the cryogenic cooler of FIGS. 1A and 1B taken along the lines B—B drawn on FIG. 1B.

Reference is now made to FIGS. 1–3 which illustrate a cryogenic cooler constructed and operative in accordance with a preferred embodiment of the present invention. The cryogenic cooler comprises an electric motor housing 10 in which is disposed an electric motor 12. It is a particular feature of the present invention that the rotor 13 and motor control electronics 15 of electric motor 12 are sealed from the interior of the cryogenic cooler through which refrigerant passes, in order to prevent contamination thereof by particulate matter from the motor 12.

A rotational shaft 14 of the electric motor 12 is mounted on a bearing 16 and terminates in a crankshaft 18, which is mounted by means of a bearing 20 in a compressor housing 22, which is fixedly mounted onto electric motor housing 10. A piston rod 24 portion of a drive shaft 25 is mounted onto crankshaft 18 via a bearing 26 and drives a piston 28 in oscillatory motion within a piston sleeve 30.

Piston 28 is formed with an internal piston rod mounting element 32 for engagement with the piston rod 24. It is a particular feature of the present invention that a labyrinth seal 34 is defined between the piston 28 and the sleeve 30 to serve as a dynamic seal. The labyrinth seal avoids disadvantages of prior art dynamic seals employed in prior art cryogenic coolers, and significantly lowers the amount of particulate material released into the refrigerant by wear of the piston elements. Preferably, the labyrinth is defined in the cylindrical side walls of the piston as shown.

As seen particularly in FIG. 2, drive shaft 25 is a bifurcated element which includes an expander piston drive portion 36, typically at 90 degrees to piston rod portion 24, which is drivingly connected via a connector rod 38 to a piston 40 forming part of an expander-displacer unit 42, otherwise referred to as a "cold finger".

Piston 40 moves in sealed oscillatory motion within a piston sleeve 44. As is the case with piston 28, a dynamic seal is provided between piston 40 and sleeve 44, preferably by means of a labyrinth seal configured onto piston 40 as shown.

It is a particular feature of the present invention that the expander-displacer unit 42, and particularly piston sleeve 44, is vibrationally isolated from the compressor and the compressor housing 22. This isolation is provided by means of metal bellows 46 or by any other suitable vibration absorber. Suitable bellows are available from servomatic Corporation of Cedar Grove, N.J. 07009, and are included in Bulletin BE-280.

A refrigerant gas connection 48 is provided between the interior of piston sleeve 30 and the interior of piston sleeve 44. In order to enhance the vibrational isolation of the expander-displacer unit 42, vibration insulating bellows 50 is provided as part of this connection 48.

The expander-displacer unit 42 comprises a relatively thin walled tube 52, typically formed of stainless steel. Disposed in free-floating relationship within tube 52 is a regenerator heat exchanger 53 comprised of several hundred fine-mesh metal screens 54, stacked to form a cylindrical matrix. Alternatively, the regenerator heat exchanger may comprise stacked balls or other suitable bodies.

Screens 54 are particularly susceptible to clogging by spurious particulate matter in the refrigerant, and therefore, the placement of the electric motor outside of communication with the refrigerant and the use of labyrinth seals significantly enhances the operating lifetime of the heat exchanger 53.

According to a preferred embodiment of the invention, a detector, such as an infra-red detector 56, may be mounted directly on the tip 58 of the cold finger 42. This is made possible by the vibration insulation of the cold finger 42 described hereinabove. The mounting of the infra-red detector 56 directly on the cold finger significantly increases the efficiency of cooling of the detector 56 by eliminating thermal losses which would result from less direct mounting. It thus lowers the power requirements of the cooler.

A dewar 60 is mounted on a dewar support 62, which is in turn mounted on bellows 46 in sealed, surrounding relationship with cold finger 42 and detector 56. An infra-red transmissive window 64, typically formed of germanium, is defined adjacent detector 56 to permit infra-red radiation to impinge onto the detector.

It will be appreciated by persons skilled in the art that the present invention is not limited by what has been particularly shown and described hereinabove. Rather the scope of the present invention is defined only by the claims which follow:

We claim:

1. An integral Stirling cryogenic cooler comprising:
a compressor;
an expander-displacer defining an expansion volume;
a cold tip adjacent said expansion volume;
a regenerator heat exchanger and a displacer;
a crank shaft arranged to receive input rotary power and to drive the compressor and the displacer; and
Bellows means for low vibration mounting of the cold tip with respect to the compressor.

2. A cryogenic cooler according to claim 1 and also comprising vibration sensitive apparatus to be cooled, which is mounted directly on the cold tip.

3. A cryogenic cooler according to claim 1 and wherein the means for low vibration mounting comprises a sealed bellows mounting.

4. A cryogenic cooler according to claim 2 and wherein the means for low vibration mounting comprises a sealed bellows mounting.

5. A cryogenic cooler according to claim 1 and wherein the expander-displacer comprises a dynamic labyrinth seal.

6. A cryogenic cooler according to claim 2 and wherein the expander-displacer comprises a dynamic labyrinth seal.

7. A cryogenic cooler according to claim 3 and wherein the expander-displacer comprises a dynamic labryinth seal.

8. A cryogenic cooler according to claim 4 and wherein the expander-displacer comprises a dynamic labyrinth seal.

9. A cryogenic cooler according to claim 1 and wherein the compressor comprises a dynamic labyrinth seal.

10. A cryogenic cooler according to claim 2 and wherein the compressor comprises a dynamic labyrinth seal.

11. A cryogenic cooler according to claim 3 and wherein the compressor comprises a dynamic labyrinth seal.

12. A cryogenic cooler according to claim 4 and wherein the compressor comprises a dynamic labyrinth seal.

13. A cryogenic cooler according to claim 1 and also comprising electric motor apparatus for driving the compressor and expander-displacer and being located externally of the compressor and expander-displacer portion and not in fluid communication with the interiors thereof.

14. A cryogenic cooler according to claim 3 and also comprising electric motor apparatus for driving the compressor and expander-displacer and being located externally of the compressor and expander-displacer portion and not in fluid communication with the interiors thereof.

15. A cryogenic cooler according to claim 5 and also comprising electric motor apparatus for driving the compressor and expander-displacer and being located externally of the compressor and expander-displacer portion and not in fluid communication with the interiors thereof.

* * * * *